US005275317A

United States Patent [19]

Rogers et al.

[11] Patent Number: 5,275,317

[45] Date of Patent: Jan. 4, 1994

[54] HANDGUN HOLSTER WITH A LOCKABLE TRIGGER GUARD RESTRAINT

[75] Inventors: William H. Rogers; Norman E. Clifton, Jr., both of Jacksonville, Fla.

[73] Assignee: Safariland, Ltd., Inc., Ontario, Calif.

[21] Appl. No.: 757,944

[22] Filed: Sep. 12, 1991

Related U.S. Application Data

[63] Continuation-in-part of Ser. No. 665,097, Mar. 6, 1991, Pat. No. 5,100,036.

[51] Int. Cl.[5] ..... F41C 33/02

[52] U.S. Cl. ..... 224/244; 224/911

[58] Field of Search ..... 224/244, 243, 911

[56] References Cited

U.S. PATENT DOCUMENTS 5,018,654 5/1991 Rogers et al. ..... 224/244

5,048,735 9/1991 McCormick ..... 224/244

*Primary Examiner*—Linda J. Sholl

*Attorney, Agent, or Firm*—Arthur G. Yeager

[57] ABSTRACT

A lockable restraining device in a holster has a rigid body portion and two upwardly extending oppositely facing wall members forming a channel therebetween to receive a handgun trigger guard, a pivotable cam member in at least one wall member having two lobes; a first lobe being pivotable to extend inwardly of the channel when the holster is empty and being pivotable outwardly of the channel when the trigger guard of the handgun is seated in the channel; and a second lobe being pivoted outwardly of the channel when the holster is empty and being pivotable inwardly of the trigger guard when the gun is seated in the holster; and a locking means engagable with the cam to prevent it being pivoted and a finger operable member to unlock the locking means.

28 Claims, 6 Drawing Sheets

HANDGUN HOLSTER WITH A LOCKABLE TRIGGER GUARD RESTRAINT

RELATED PATENT APPLICATION

This is a continuation-in-part of our copending application, Ser. No. 07/665,097 filed Mar. 6, 1991, now U.S. Pat. No. 5,100,036 issued Mar. 31, 1992.

BACKGROUND OF THE INVENTION

This invention relates to a handgun holster with a lockable trigger guard restraint for retaining the handgun in the holster and preventing it from being removed until desired by the wearer.

Law enforcement officers, and particularly competitive shooters who have a need to carry a handgun normally do so in a holster, and it is important that the holster permit a "quick draw", and yet be secure in the holster against falling out when the wearer is running or otherwise involved in activity, and against the possibility of withdrawal by someone other than the wearer. Various arrangements have been used such as, cover flaps, restraining straps, spring mechanisms, custom molding of the holster to fit each gun, and the like. Typical of such arrangements are those shown in my U.S. Pat. No. 4,694,980; in U.S. Pat. No. 4,101,060 to Bianchi; and my U.S. Pat. No. 4,925,075. The present invention discloses improvements over all of these prior art holsters. Our copending parent application Ser. No. 07/665,097 filed Mar. 6, 1991 now U.S. Pat. No. 5,100,031 issued Mar. 31, 1992, discloses and claims a handgun holster having a restraining device which frictionally engages the trigger guard of a handgun and obstructs its removal except when moved in specific directions.

It is an object of the present invention to provide an improved handgun holster. It is another object of this invention to provide an improved holster having a novel means for locking the handgun in the holster until the wearer unlocks it for removal. Still other objects will become apparent from the more detailed description which follows.

BRIEF SUMMARY OF THE INVENTION

This invention relates to an improved handgun holster having a locking means which engages the trigger guard of the handgun to permit withdrawal from the holster only when the locking means has been unlocked, the holster having a restraining device attached to the inside of the back of the holster adjacent its top, the restraining device being an elongated article having a solid rigid body portion and two upwardly extending vertical side wall members attached to opposite sides, respectively, of the body portion, said side walls forming a channel for receiving and seating a trigger guard. At least one of the side wall members has a pivotable cam member having a pair of lobes, the first lobe being pivotable to extend inwardly into the channel when the holster is empty and to be pivoted outwardly to permit seating of the trigger guard and the second lobe being pivoted out of the channel when the holster is empty and pivoted inwardly of the trigger guard to lock same when the trigger guard is seated; and an automatic locking means to prevent pivoting of the cam member after the trigger guard is seated in the holster until the wearer unlocks the means by movement of a finger operated member extending upwardly from the top of the holster near the body of the wearer.

In specific and preferred embodiments of the invention there is a nodule on the back side of a V-shaped cam which bears against a pivotable unlocking lever. In another embodiment a C-shaped cam has a recess into which is inserted a prong member to lock the cam against pivoting and a spring biased plunger member is pushed to retract the prong member and unlock the cam.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DESCRIPTION OF THE INVENTION

The various features of this invention are best understood from the following description with reference to the accompanying drawings.

Figure 1:
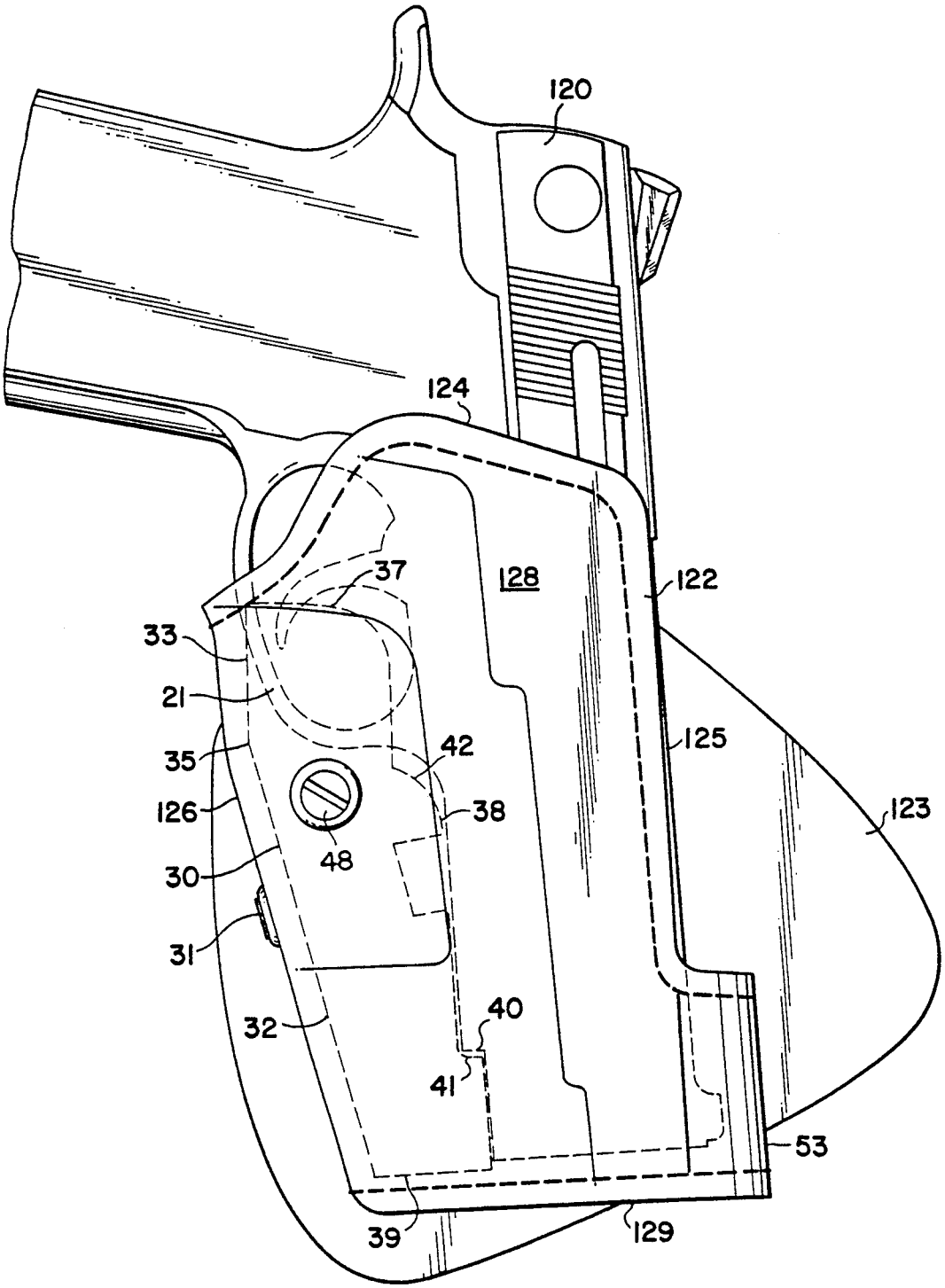
FIG. 1 is an outside elevational view of the first embodiment of the holster of this invention with an automatic handgun therein.
Figure 2:
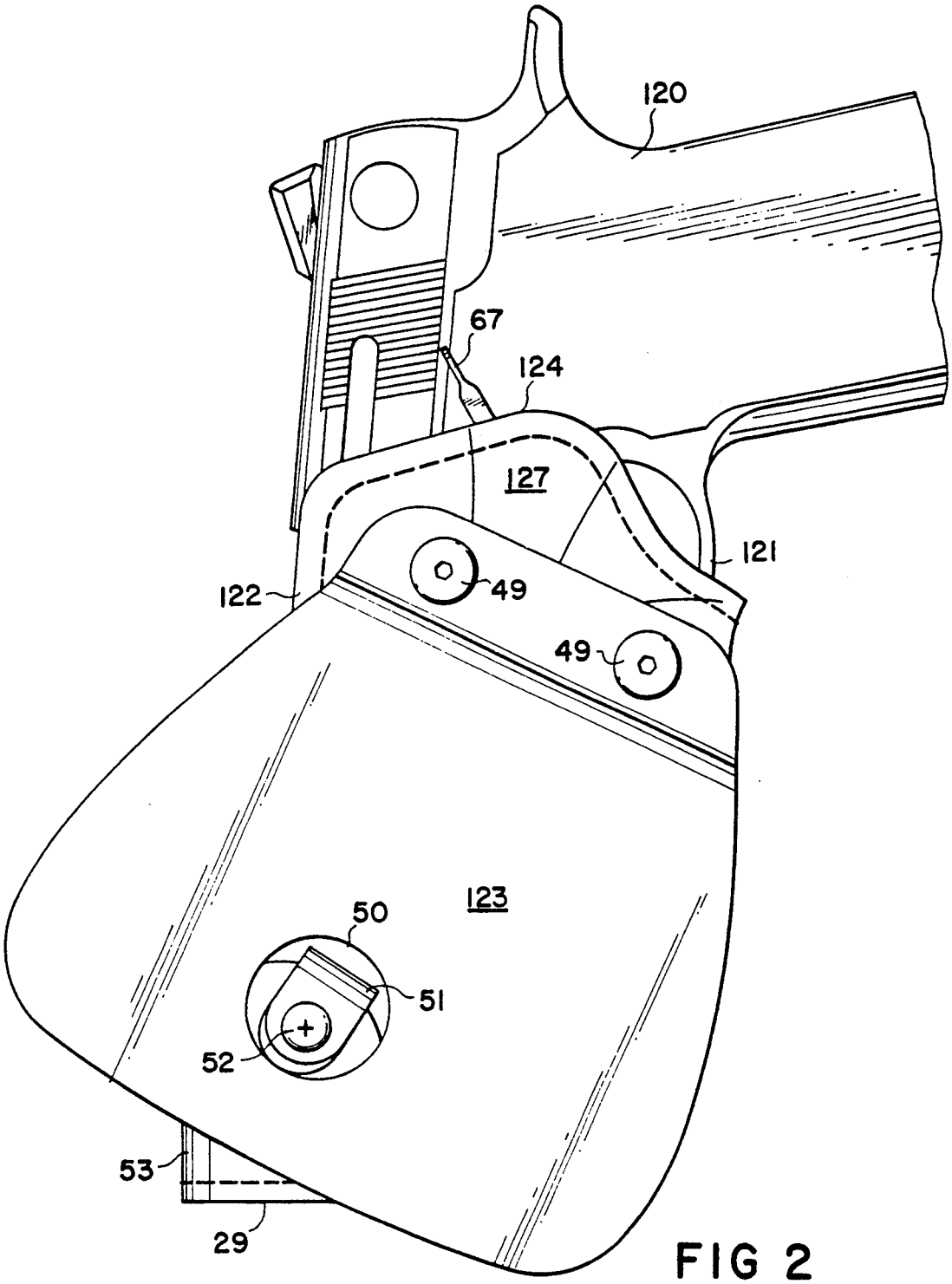
FIG. 2 is an inside elevational view of the holster and handgun of FIG. 1.
Figure 10:
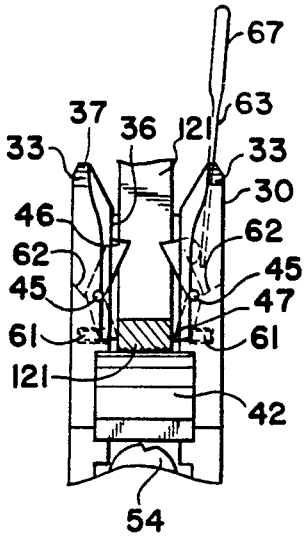
FIG. 10 is a front elevational view of the portion shown in FIG. 9.
Figure 3:
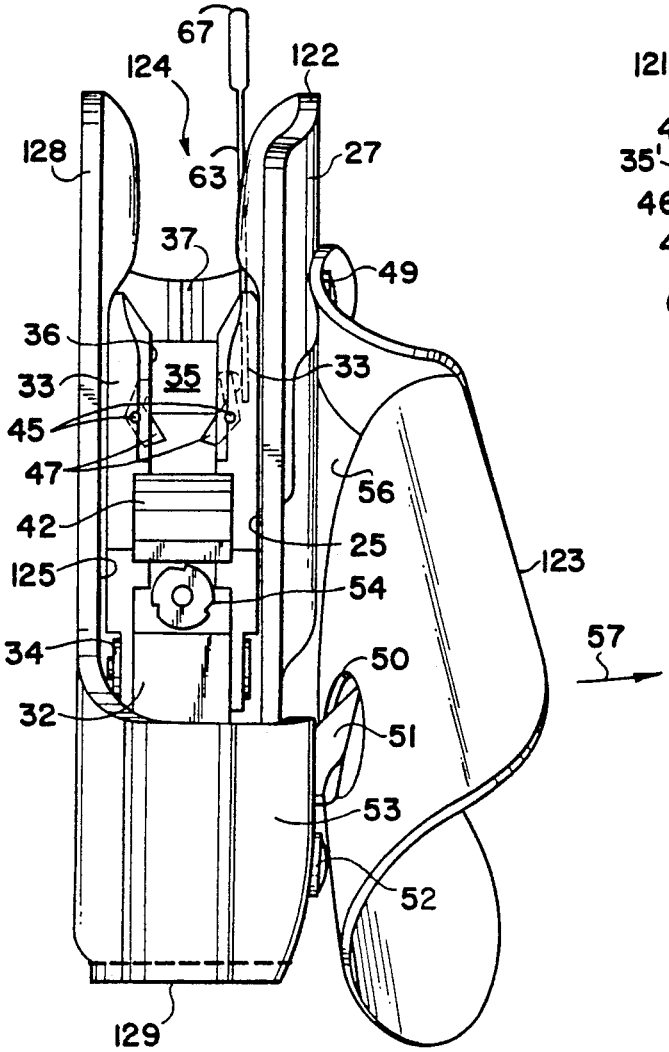
FIG. 3 is a front elevational view of the holster of this invention.

The holster, as seen in FIGS. 1-3, comprises an inner wall 127 and an outer wall 128, an open top 124, a bottom 129, enclosing a space in which a handgun is carried. These components as well as others in the following disclosure, are intended to describe directions and relative locations with respect to the wearer of the holster. Thus, inner wall 127 is closer to the body of the wearer than outer wall 128, and top 124 is vertically above bottom 129. A space 56 for the waist belt of the wearer is formed between hip pad 123 and inner wall 127. Hip pad 123 is attached to holster 122 by screws 49 leaving the lower end free to be sprung outward in the direction of arrow 57. When hip pad 123 is sprung outward, the waist belt of the wearer can be slid over stop tab 51 which is wedge-shaped to its normal position. Hole 50 in hip pad 123 is provided to permit tab 51 to extend outward when the holster is in place to provide a positive stop to prevent unintended release of the holster 122 from the belt. Screw 52 holds tab 51 fixed against inner wall 127. The inside of the hip pad resting against the wearer is preferably molded into a concave shape to fit the wearer's contours.

Holster 122 has an open front 125 extending from open top 124 to flap 53 which wraps around from front 125 to inner wall 127 and is fastened thereto with screw 54. Bottom 129 is open but handgun 120 cannot extend through bottom 129, because the restraining device 30, hereinafter more fully described, holds the handgun 120 in place due to it being molded to engage and fit the trigger guard of handgun 120.

The principal improvement of this invention which is believed to be novel and inventive is the lockable restraining device 30 which is fastened within the holster 122 along its back 126 generally medially between top 120 and bottom 129. A preferred method of fastening the device 30 to the holster back 126 is by screw 31 passing through holster back 126, hole 55 in device 30 and engaged with threaded nut 54. Other fastening methods, e.g., riveting or cementing, are entirely suitable for some purposes. Restraining device 30 is an elongated article having a solid, rigid main body member 32 to which are attached two upwardly extending side wall members 33 by rivet 34 or other equivalent fastening means. The attachment to side wall members 33 may, if desired, be only at the bottom ends 58, leaving upper ends 59 free to flex in the direction of arrow 60. The rigid main body member 32 may thus be molded to the desired length and shape, particularly the trigger guard corresponding to the handgun to be holstered and the same side wall members 33, as shown herein, may be connected thereto to form a restraining device 30 which corresponds to that particular handgun. It is entirely suitable in certain embodiments of this invention for side walls 33 to be rigidly attached to main body member 32 or alternatively, for restraining device 30 to be a single, integrally molded article.

Main body member 32 is a rigid solid which is formed to fit inside holster 122 against its back wall 126 and to form a base to which side wall wings or members 33 are attached. Side wall wings 33 together with back 35 of body member 32 form a channel or recess 36 into which the trigger guard 121 of handgun 120 is seated. Channel or recess 36 is open at the top and at the front. The flexibility of side wall wings 33 assists in permitting proper entry and seating of handgun 120 into holster 122, particularly trigger guard 121 into restraining device 30. In the embodiment wherein restraining device 30 has flexible side walls 33, the amount of flexibility may be adjustable by means of a screw 48 passing through hole 43 to a nut (not shown) attached to inner wall 127. Tightening screw 48 pulls side wall wings 33 closer together, thus applying a tighter grip on handgun 120 making it more difficult to push handgun 120 into holster 122 and vice versa making it more difficult to draw handgun 120 from holster 122. The latter difficulty is actually a benefit in securing handgun 120 in holster against falling out during a scuffle and providing some protection against withdrawal of the gun by someone other than the wearer.

Figure 8:
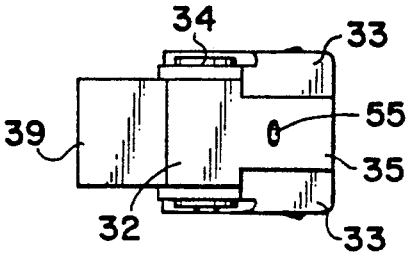
FIG. 8 is a bottom plan view of the gun restraining device of this invention.
Figure 9:
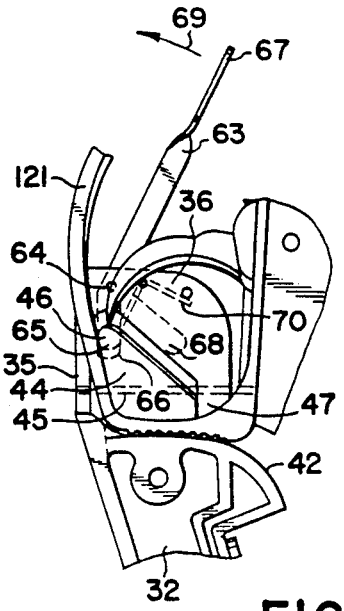
FIG. 9 is a side elevational view of a portion of the restraining device of this invention showing details of engagement with trigger guard of a handgun.
Figure 12:
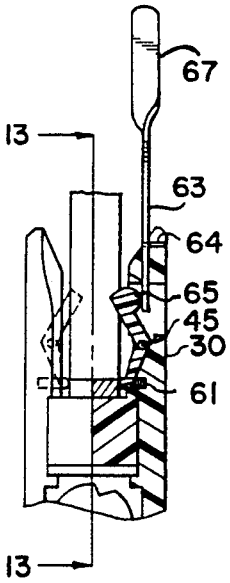
FIG. 12 is a front elevational view, partly in cross section, of the embodiment of FIG. 10.

The restraining element 44 in device 30, shown in FIGS. 3-10 and 12-15, is a V-shaped cam member in each side wall wing 33, each element 44 having a generally triangular and vertically extending upper second lobe 46 and a generally rectangular and horizontally extending lower first lobe 47 and a pivot pin 45 passes therethrough generally between the lobes 46 and 47. Element 44 pivots about pin 45 so as to expose the end of lobe 46 or the end of lobe 47 in channel 36. The dimensions of element 44 and the positioning of pivot pin 45 are such that first lobe 47 contacts the side edges of the trigger guard 121 of handgun 120 when handgun 120 is holstered. The side edges of the trigger guard 121 force horizontal first lobes 47 outward away from trigger guard 121 and substantially flush into recess 62 in side wall wing 33 causing element 44 to pivot about pin 45 and causing the end of each vertical second lobe 46 to extend inwardly into channel 36 and inside of trigger guard 121, providing a positive restraint against handgun 120 falling out of or being removed from holster 122. This positive restraint position is shown in FIGS. 8 and 9. Preferably the lower lobes 47 are spring loaded inwardly as illustrated by springs 61 in FIG. 10 and the trigger guard 121 of handgun 120 when holstered forces lower lobes outwardly to further compress the springs 61 and when the trigger guard is removed the lower lobes 47 project inwardly as clearly shown in FIG. 6.

Figure 11:
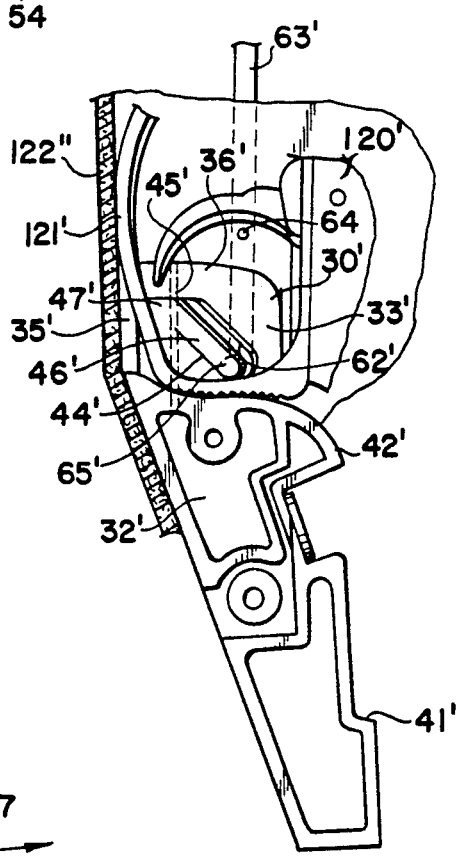
FIG. 11 is a second embodiment of a portion of the holster with lockable gun restraining device of this invention.
Figure 7:
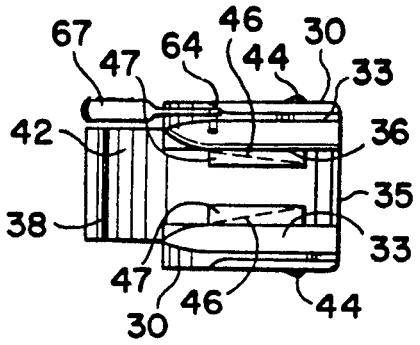
FIG. 7 is a top plan view of the gun restraining device of this invention.
Figure 5:
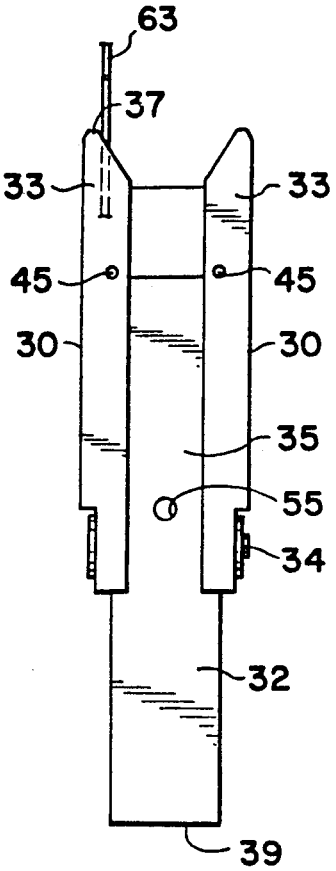
FIG. 5 is a back elevational view of the gun restraining device of this invention.
Figure 4:
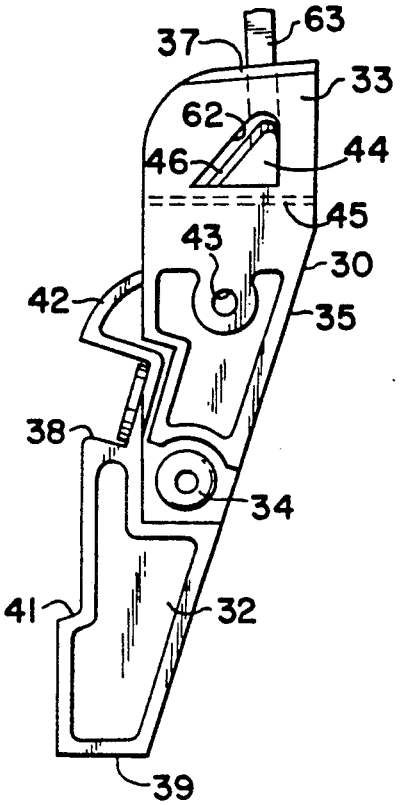
FIG. 4 is a side elevational view of the gun restraining device of this invention.
Figure 6:
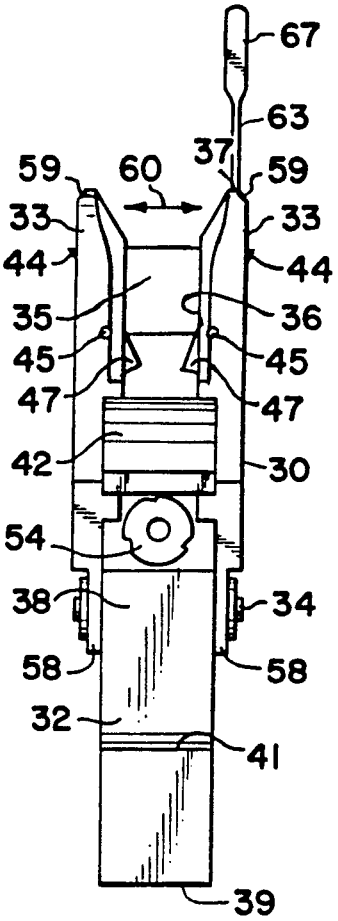
FIG. 6 is a front elevational view of the gun restraining device of this invention.
Figure 13:
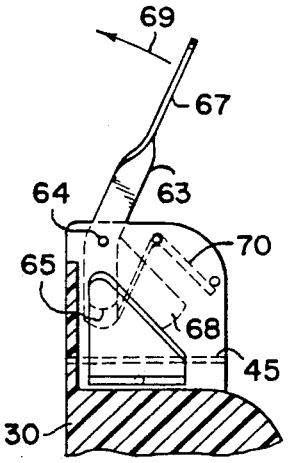
FIG. 13 is a cross sectional view taken at 13—13 of FIG. 12.

The locking means for maintaining restraining element 44 in a locked position is best seen in FIGS. 3, 9 and 12-14. Locking lever 63 is positioned inside of side wall 33 of device 30 next to the body of the wearer. Lever 63 has an upper portion 67 extending upward at the top 124 of holster 122 for manipulation by a finger, preferably by the thumb of the wearer to move portion 67 rearwardly in the direction of arrow 69 to release the locking means and allow the gun to be withdrawn from holster 122. Lower portion 66 of lever 63 bears against a raised nodule 65 on the back side of lobe 46. When portion 66 bears against lobe 46 it prevents cam member 44 from pivoting and keeps lobe 46 inside the trigger guard 121 of handgun 120. Lever 63 is a dog-leg member pivoting around pin 64 which is substantially horizontal. When upper portion 67 is moved to the right (in FIG. 9) lower portion is in locked position 66 (in FIG. 9), and when upper portion 67 is moved to the left in the unlocked position 68 (in FIG. 9) where it does not touch nodule 65 and permits member 44 to pivot. In FIG. 11 cam member 44' is mounted on a vertical pivot pin 45' and in this instance lever 63' need not be a dog-leg shape and merely must pivot about pin 65' to be free of nodule 65' on the back side of lobe 46'. There is also shown in FIGS. 9 and 13 a spring means 70 bearing against lower arm 66 of lever 63 to urge lever 63 into the locked position. This insures that the handgun 120 is automatically locked into restraining device 30 when handgun 120 is seated in the holster 122, requiring a positive action by the wearer to release the handgun 120 for withdrawal.

Figure 14:
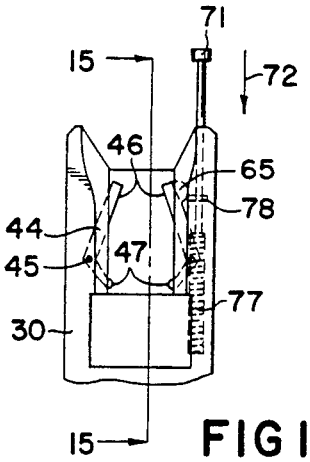
FIG. 14 is a front elevational view of a third embodiment of the lockable restraining device of this invention.
Figure 15:
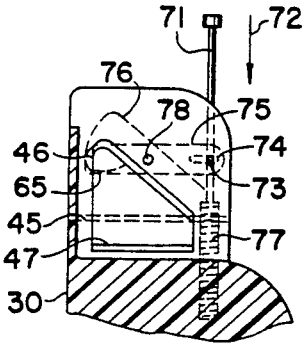
FIG. 15 is a cross sectional view taken at 15—15 of FIG. 14.

FIGS. 14 and 15 show a third embodiment of the locking means in the same restraining device 30. In this instance there also is a V-shaped cam 44 with lobes 46 and 47 functioning as described above. In this embodiment the unlocking means is accomplished by pushing downwardly in the direction of arrow 72 on plunger rod 71. Rod 71 is operatively connected to lever 72 by a pin 73 in rod 71 via a slot 74 in lever 72. Lever 72 is pivoted about pin 78 to move from locked position 75 to unlocked position 76. In the locked position 75 lever 72 bears against nodule 65, and in the unlocked position 76 lever 72 does not touch nodule 65. Rod 71 is biased upwardly by spring 77 so as to automatically lock the handgun in the holster when seated therein.

Figure 16:
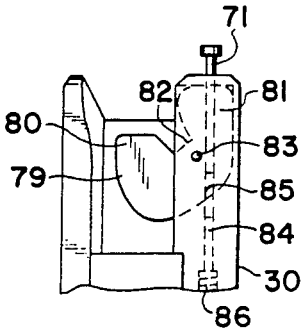
FIG. 16 is a front elevational view of a fourth embodiment of this invention in the position for receiving the gun to be holstered.
Figure 17:
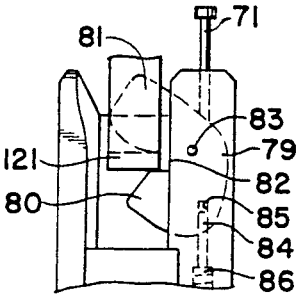
FIG. 17 is the same view as FIG. 16 in the position after the gun is holstered.
Figure 18:
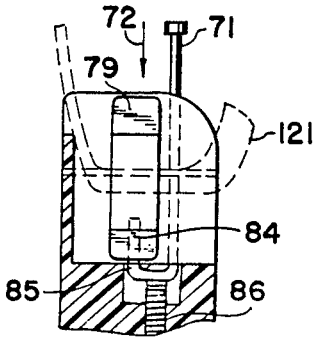
FIG. 18 is a side elevational view of the holster of FIG. 17.
Figure 19:
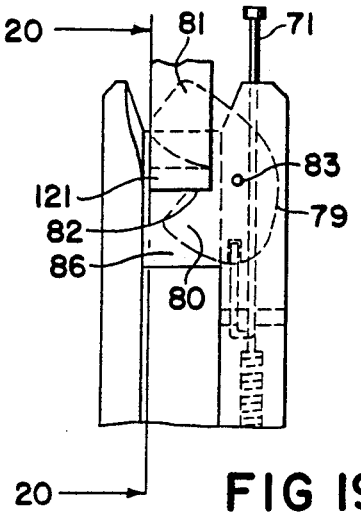
FIG. 19 is a front elevational view of a fifth embodiment of this invention.
Figure 20:
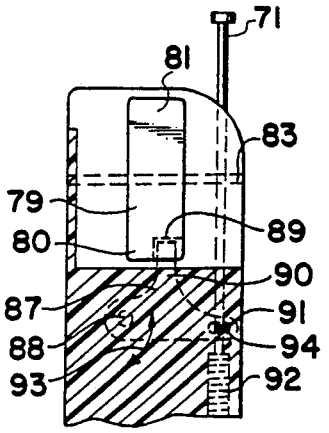
FIG. 20 is a cross sectional view taken at 20—20 of FIG. 19.
Figure 22:
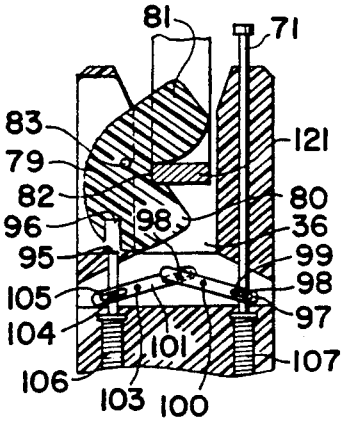
FIG. 22 is a cross sectional view taken at 22—22 of FIG. 21.
Figure 21:
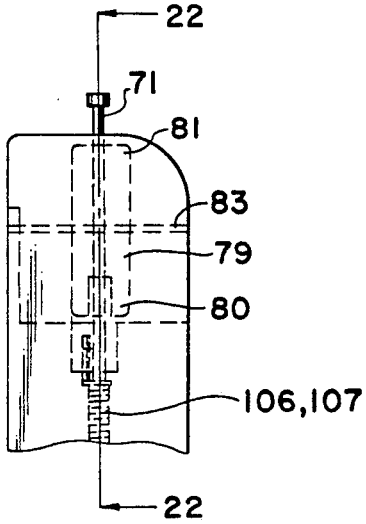
FIG. 21 is a side elevational view of a sixth embodiment of this invention.
Figure 24:
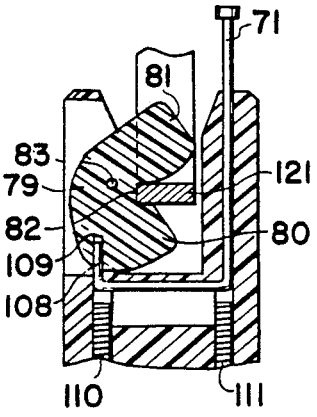
FIG. 24 is a cross sectional view taken at 24—24 of FIG. 23.
Figure 23:
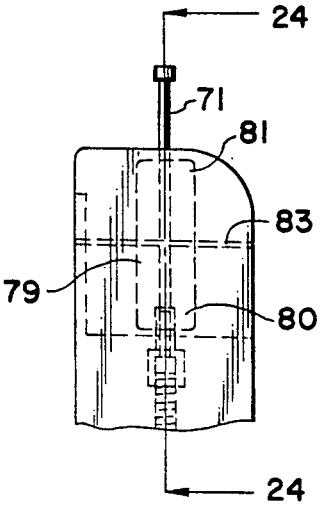
FIG. 23 is a side elevational view of a seventh embodiment of this invention.

In FIGS. 16–23 the cam member of the locking means is a C-shaped cam 79 having a lower first lobe 80 and an upper second lobe 81 functioning exactly as corresponding lobes 47 and 46 respectively of FIGS. 1–15. A space between lobes 80 and 81 forms a notch 82 which functions as a seat for the trigger guard 121 of the handgun 120 in holster 122. Cam 79 pivots around horizontal pin 83 as the handgun is inserted into or withdrawn from holster 122. Plunger rod 71 is pushed downwardly in the direction of arrow 72 to unlock these locking means of FIGS. 16–23. In the embodiment of FIGS. 16–18 plunger rod 71 has the shape of the letter "J" with its lower end 84 being a prong member which fits in a male/female connection with a recess 85 in lower first lobe 80. A spring means 86 urges prong member 84 upwards into recess 85 to lock cam 79 against pivoting and, thereby, to lock the handgun 120 in its holster 122. It should be noted that this type of cam seats the trigger guard 121 in notch 82 above the bottom of channel 36 when cam 79 has rotated until lobe 81 rotates to touch the side wall or channel 36. In the fifth embodiment of FIGS. 19–20 a lever 87 has an upwardly directed arm 90 that fits into a notch 89 in lower first lobe 80. Lever 87 pivots around pin 88 in the direction of arrow 93. When arm 90 is in notch 89 cam 79 cannot rotate and the gun is locked in the holster. When it is desired to unlock cam 79 the wearer pushes downwardly on plunger arm 71 having a pin 91 which engages a slot 94 in lever 87 causing lever 87 to pivot downwardly to remove lever arm 90 from notch 89. Spring 92 urges rod 71 upwardly to lock, cam 79 when the gun is again seated in the holster. In the sixth embodiment of FIGS. 21–22 cam 79 is locked by a prong member 95 inserted upwardly into recess 96 of cam 79. The unlocking mechanism is operated by pushing downwardly on rod 71 which is connected to first lever 97 by pin 98 in slot 99. First lever 97 is pivoted about pin 100 and connected to second lever 101 by pin 102. Second lever 101 is pivoted about pin 103 and connected to prong 95 by a pin 104 operating in slot 105. Prong 95 is urged upwardly by spring 106 and rod 71 is urged upwardly by spring 107, both springs tending to lock trigger guard 121 in the holster. In the seventh embodiment in FIGS. 23–24 rod 71 has a J-shape as in FIGS. 16–18, but with a broader reach so as to allow cam 79 to be reversed from its position in FIGS. 16–18 where it is operated from the side wall off restraining unit closer to the wearer. In FIGS. 23–24 cam 79 is operated from the side wall away from the wearer, i.e., pivot pin 83 is in the side wall away from the wearer. The end of the J-shaped rod 71 forms an upwardly projecting prong 108 which is inserted into recess 109 in lobe 80 to lock cam 79. Unlocking cam 79 is also accomplished by pushing downwardly on rod 71 to withdraw prong 108 from recess 109. Because of the reach from rod 71 to prong 108 there are two springs, 110 for prong 108 and 111 for rod 71, to urge prong 108 into the locking position. Generally it is preferred to also employ a spring means to rotate cam 79 from its locked position to its open position ready to receive the handgun as it is inserted into the holster. A coil spring or leaf spring fastened around pivot pin 83 is recommended. This would, for example, help to move cam 79 from its locked position shown in FIG. 17 to its open position in FIG. 16 once prong 84 was withdrawn from recess 85. It is, of course, possible to employ eccentric weighting of cam 79 to cause it to rotate in this fashion.

At the top end of main body 32 is a rounded convex tongue 42 which extends forwardly from the bottom of channel 36. This tongue 42 serves as a guide to lead the muzzle of the handgun and thus the trigger guard 21 into channel 36 simply by feel, thus facilitating in the holstering of handgun 20.

At the lower portion of main body 32 adjacently above bottom 39 there is a horizontal ledge 41 positioned to receive a mating horizontal ledge 40 on a handgun 20. This is not a critical component of this invention, but is a convenient option to employ to provide a more secure and positive seating for handgun 20 in holster 22. Ledge 41 is positioned to match the contours of handgun 20, and therefore may be different in design and/or location depending on the type and model of handgun 20.

Holster 22 preferably is made of a moldable leather/-plastic laminate which is processed to have the unique contours to receive a selected handgun 20 and is not suitable as a holster for any other gun shape.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A handgun holster having a lockable trigger guard restraining device adapted to selectively prevent withdrawal of a handgun having a trigger guard from said holster, said holster having with respect to a wearer an inner wall, an outer wall, a front, a back, a top, a bottom, an inside, an outside, and a means for suspending said holster from a belt worn by a wearer, the improvement which comprises a handgun restraining device attached to said inside of said holster at said back adjacent said top, said restraining device being an elongated article having a solid rigid body portion and two upwardly extending vertical side wall members attached to opposite sides respectively of said body portion forming a channel adapted to receive and seat therein a trigger guard of a handgun, at least one of said upper ends including a pivotable cam member having two lobes, a first said lobe being adapted to extend inwardly into said channel when the holster is empty and to be pivoted outwardly to permit seating of the trigger guard in said channel, and a second said lobe being positioned outwardly of said channel when the holster is empty and to extend inwardly of the trigger guard when the trigger guard is seated in said channel; an automatic locking means to prevent said cam from pivoting when said second lobe is extended inwardly of said trigger guard said locking means including a finger operable member to unlock said locking means.

2. The holster of claim 1 wherein said cam member is V-shaped and pivotable about the apex of said V with said second lobe being spring-biased to be outwardly of said channel.

3. The holster of claim 2 wherein said automatic locking means includes an outwardly projecting nodule on the portion of said second lobe away from said channel, and said finger operable member including a lever means adapted to be pivoted from a position bearing against said nodule to a position bearing against said nodule to a position not touching said nodule.

4. The holster of claim 3 wherein said lever means comprises a pivotable lever arm with a finger contact portion extending upwardly from said vertical side wall member next to the body of the wearer to an upper end above the top of the holster, and a cam nodule contact portion extending downwardly behind said second lobe and said nodule, said lever arm being pivotable to move forward and rearward with respect to the wearer.

5. The holster of claim 3 wherein said lever means includes a pair of mutually pivotable lever arms, one of which is movable from a position bearing against said nodule to urge said second lobe inside the trigger guard to a position free of touching said nodule, and the other of which is connected to a vertically movable plunger extending upwardly of the top of said holster.

6. The handgun holster of claim 1 wherein said cam member is C-shaped with said two lobes being the two ends of said C and said locking means including a prong member and a recess in said cam member adapted to receive said prong member therein which prevents pivoting of said cam member when inserted in said recess.

7. The handgun holster of claim 6 wherein said prong member is spring biased toward being inserted into said recess.

8. The holster of claim 5 wherein said movable plunger is located on the side of the holster next to the body of the wearer.

9. The holster of claim 1 further comprising a spring means biased to urge said first lobe to extend inwardly into said channel.

10. The holster of claim 6 wherein said prong member is movable by the vertical movement of a plunger rod extending upwardly of the top of said holster from the side next to the wearer.

11. The holster of claim 1 wherein said cam pivots about a pin which is positioned substantially horizontal.

12. The holster of claim 6 wherein said two lobes of said cam are spaced apart sufficiently to form a notch which functions as a seat for said trigger guard when said handgun is fully inserted into said holster.

13. A handgun holster having a lockable and releasable trigger guard restraining device adapted to selectively prevent withdrawal of a handgun having a trigger guard from said holster, said holster having with respect to a wearer an inner wall, an outer wall, a front, a back, a top, a bottom, an inside, an outside, and a means for suspending said holster from a belt worn by a wearer, the improvement which comprises a handgun restraining device attached to said inside of said holster at said back adjacent said top, said restraining device including a rigid body portion and two upwardly extending vertical side wall members attached to opposite sides respectively of said body portion forming a channel adapted to receive and seat therein a trigger guard of a handgun, said wall members having upper end portions, a pivotable cam member having two lobes and being attached to one said wall member, a first said lobe being adapted to extend inwardly into said channel when said holster is empty and to be pivoted outwardly to permit seating of a trigger guard in said channel, and a second said lobe being positioned outwardly of said channel when said holster is empty and to extend inwardly of a trigger guard when a trigger guard is seated in said channel, an automatic locking means to prevent said cam from pivoting when said second lobe is extended inwardly of a trigger guard to lock same in said holster, said locking means including a finger operable member to selectively unlock said locking means to release a trigger guard to permit withdrawal of a handgun.

14. The holster of claim 13 wherein said cam member is generally V-shaped and pivotable about the apex of said V with said second lobe spring biased to be outwardly of said channel.

15. The holster of claim 14 which additionally comprises an outwardly projecting nodule on a portion of said second lobe away from said channel, said finger operable member including a lever means adapted to be pivoted from a position bearing against said nodule to a non-bearing position.

16. The holster of claim 15 wherein said lever means includes a pivotable lever arm with a finger contact portion extending upwardly from said vertical side wall member next to a body of a wearer to an upper end above said top of said holster, and a cam nodule contact portion extending downwardly behind said second lobe, said lever arm being pivotable to move forward and rearward with respect to a wearer.

17. The holster of claim 15 wherein said lever means includes a pair of mutually pivotable lever arms, one of which is movable from a position bearing against said nodule to urge said second lobe inside a trigger guard to a non-bearing position, and another of which is connected to a vertically movable plunger extending upwardly of said top of said holster.

18. The holster of claim 17 wherein said movable plunger is located adjacent said inner wall of said holster next to a body of a wearer.

19. The handgun holster of claim 13 wherein said cam member is C-shaped with said two lobes forming ends of said C-shaped member, locking means including a prong member and a recess in said cam member adapted to receive said prong member therein which prevents pivoting of said cam member when said prong member is inserted in said recess.

20. The handgun holster of claim 19 wherein said prong member is spring biased toward said recess.

21. The holster of claim 19 wherein said prong member is movable by vertical movement of a plunger rod extending upwardly of said top of said holster from adjacent said inner wall of said holster next to a wearer.

22. The holster of claim 19 wherein said two lobes of said cam are spaced apart sufficiently to form a notch which functions as a seat for a trigger guard when a handgun is fully inserted into said holster.

23. The holster of claim 13 further comprising spring means biased to urge said first lobe to extend inwardly into said channel.

24. The holster of claim 13 wherein said cam pivots about a pin which is positioned substantially horizontal.

25. The holster as defined in claim 13 further comprising another pivotable cam member having two lobes and being attached to another said wall member.

26. The holster of claim 25 further comprising a pair of pins respectively mounting said cam members to respective said wall members.

27. The holster of claim 26 wherein said pins are substantially parallel and extend generally horizontally.

28. The holster of claim 26 wherein said pins are substantially parallel and extend generally vertically.

* * * * *